US010214852B2

(12) United States Patent
Charlton

(10) Patent No.: US 10,214,852 B2
(45) Date of Patent: Feb. 26, 2019

(54) PORTABLE GARMENT STEAMER

(71) Applicant: Techtronic Floor Care Technology Limited, Tortola (VG)

(72) Inventor: Christopher M. Charlton, Medina, OH (US)

(73) Assignee: Techtronic Floor Care Technology Limited, Tortola (VG)

( * ) Notice: Subject to any disclaimer, the term of this patent is extended or adjusted under 35 U.S.C. 154(b) by 315 days.

(21) Appl. No.: 15/285,669

(22) Filed: Oct. 5, 2016

(65) Prior Publication Data

US 2017/0022654 A1 Jan. 26, 2017

Related U.S. Application Data

(63) Continuation of application No. 14/148,296, filed on Jan. 6, 2014.

(51) Int. Cl.

| | |
|---|---|
| ***D06F 73/00*** | (2006.01) |
| ***D06F 87/00*** | (2006.01) |
| ***F22B 1/28*** | (2006.01) |

(52) U.S. Cl.

CPC ..... *D06F 73/00* (2013.01); *D06F 87/00* (2013.01); *F22B 1/284* (2013.01)

(58) Field of Classification Search

None

See application file for complete search history.

(56) References Cited

U.S. PATENT DOCUMENTS

| | | | |
|---|---|---|---|
| 2,234,347 | A | 3/1941 | Lobstein |
| 2,674,819 | A | 4/1954 | Zastrow et al. |
| 3,272,964 | A | 9/1966 | Carlos et al. |
| 3,395,469 | A | 8/1968 | Gilbert |
| 3,398,260 | A | 8/1968 | Martens |
| 3,413,742 | A | 12/1968 | Sueur et al. |
| 3,436,851 | A | 4/1969 | Gilbert |
| 3,485,065 | A | 12/1969 | Frank |

(Continued)

FOREIGN PATENT DOCUMENTS

| | | |
|---|---|---|
| CN | 201362798 | 12/2009 |
| CN | 102342781 | 2/2012 |

(Continued)

OTHER PUBLICATIONS

Shark, "Owner's Guide GS300", 2011, 24 pages.

(Continued)

*Primary Examiner* — Joseph M Pelham

(74) *Attorney, Agent, or Firm* — Michael Best & Friedrich LLP

(57) ABSTRACT

A steamer includes a housing, a power cord configured to be selectively coupled to an external power source, a battery, a fluid reservoir positioned in the housing, a reservoir heating element configured to preheat fluid in the fluid reservoir, a steam generating device operable to receive preheated fluid from the fluid reservoir and generate steam, and a nozzle in fluid communication with the steam generating device. The reservoir heating element receives power from the external power source when the power cord is in communication with the external power source. The steam generating device receives power from the battery when the power cord is unplugged from the external power source. The nozzle is configured to receive the steam from the steam generating device and discharge the steam through the nozzle.

17 Claims, 6 Drawing Sheets

(56) References Cited

U.S. PATENT DOCUMENTS

| | | | |
|---|---|---|---|
| 3,620,055 | A | 11/1971 | Blachly et al. |
| 3,675,449 | A | 7/1972 | Bluestein |
| 3,742,629 | A | 7/1973 | Plasko |
| 3,745,676 | A | 7/1973 | Dikoff |
| 3,755,649 | A | 8/1973 | Osrow |
| 3,760,149 | A | 9/1973 | Harsanyi |
| 3,805,425 | A | 4/1974 | Spoida et al. |
| 4,366,367 | A | 12/1982 | Mazzucco |
| 4,565,019 | A | 1/1986 | Cavalli |
| 4,571,483 | A | 2/1986 | Fathi |
| 4,640,028 | A | 2/1987 | Nakada et al. |
| 4,650,268 | A | 3/1987 | Dobson et al. |
| 4,655,523 | A | 4/1987 | Rebel |
| 4,688,339 | A | 8/1987 | Tsai |
| 4,719,334 | A | 1/1988 | Rebel |
| 4,784,616 | A | 11/1988 | Zimmermann |
| D299,573 | S | 1/1989 | Gudefin |
| 4,856,212 | A | 8/1989 | Dikoff |
| 4,857,703 | A | 8/1989 | Wilkins |
| D312,521 | S | 11/1990 | Vildosola |
| D319,121 | S | 8/1991 | Muller |
| 5,074,066 | A | 12/1991 | Sakano et al. |
| 5,117,092 | A | 5/1992 | Shimizu et al. |
| 5,120,934 | A | 6/1992 | Nakada et al. |
| 5,121,464 | A | 6/1992 | Hanada et al. |
| 5,142,124 | A | 8/1992 | Driessen |
| D335,010 | S | 4/1993 | Vildosola |
| 5,408,769 | A | 4/1995 | Patrick |
| 5,414,945 | A | 5/1995 | Freeman et al. |
| 5,512,728 | A | 4/1996 | Jalbert |
| 5,526,596 | A | 6/1996 | Bitzel et al. |
| 5,802,749 | A | 9/1998 | Barmentlo et al. |
| 6,140,610 | A | 10/2000 | Siragusa |
| D436,424 | S | 1/2001 | Buzzi |
| 6,176,026 | B1 | 1/2001 | Leung |
| D439,023 | S | 3/2001 | Powell |
| 6,212,332 | B1 | 4/2001 | Sham et al. |
| D452,354 | S | 12/2001 | Hsu |
| D463,641 | S | 9/2002 | Powell |
| D465,309 | S | 11/2002 | Foersterling |
| D467,051 | S | 12/2002 | Marbury |
| D470,986 | S | 2/2003 | Berthier |
| 6,513,269 | B2 | 2/2003 | Kobayashi et al. |
| D473,987 | S | 4/2003 | Foersterling |
| D476,160 | S | 6/2003 | Choi |
| 6,615,515 | B1 | 9/2003 | Wu |
| 6,622,404 | B2 | 9/2003 | Valiyambath |
| 6,640,472 | B1 | 11/2003 | Wu |
| 6,711,840 | B1 | 3/2004 | Rosenweig |
| 6,857,209 | B2 | 2/2005 | Wehrwein et al. |
| 6,886,373 | B2 | 5/2005 | Carrubba et al. |
| 6,917,015 | B2 | 7/2005 | Choo |
| 6,986,217 | B2 | 1/2006 | Leung et al. |
| 7,051,462 | B1 | 5/2006 | Rosenzweig |
| 7,086,186 | B2 | 8/2006 | Kobayashi et al. |
| 7,114,274 | B2 | 10/2006 | Kobayashi et al. |
| 7,155,117 | B2 | 12/2006 | Leung et al. |
| 7,188,442 | B2 | 3/2007 | Fernandez |
| D541,500 | S | 4/2007 | Leung |
| D548,418 | S | 8/2007 | Cahen |
| 7,269,878 | B2 | 9/2007 | Reese |
| D567,463 | S | 4/2008 | Garner |
| D568,021 | S | 4/2008 | Lebot et al. |
| 7,389,597 | B1 | 6/2008 | Chen |
| 7,392,607 | B2 | 7/2008 | Vialle et al. |
| D575,019 | S | 8/2008 | Choi |
| D576,369 | S | 9/2008 | Choi |
| D576,370 | S | 9/2008 | Choi |
| D579,160 | S | 10/2008 | Lebot et al. |
| D589,663 | S | 3/2009 | Massip et al. |
| 7,516,565 | B1 | 4/2009 | Tsen |
| D595,461 | S | 6/2009 | Massip et al. |
| D595,964 | S | 7/2009 | Choi |
| D601,806 | S | 10/2009 | Choi |
| D601,807 | S | 10/2009 | Choi |
| 7,661,212 | B2 | 2/2010 | Hahn |
| 7,681,343 | B2 | 3/2010 | Dugelay et al. |
| D622,457 | S | 8/2010 | Choi |
| 7,908,776 | B2 | 3/2011 | Ng et al. |
| 8,056,272 | B2 | 11/2011 | Rosenzweig et al. |
| 8,091,747 | B2 | 1/2012 | Haan |
| 8,272,152 | B2 | 9/2012 | Fernandez |
| 2005/0028408 | A1 | 2/2005 | Tobias et al. |
| 2005/0278988 | A1 | 12/2005 | Fernandez |
| 2006/0018638 | A1 | 1/2006 | Leung |
| 2006/0191299 | A1 | 8/2006 | Tobias et al. |
| 2007/0130718 | A1 | 6/2007 | Chung et al. |
| 2007/0133962 | A1 | 6/2007 | Rizzuto et al. |
| 2008/0040953 | A1 | 2/2008 | Leung |
| 2008/0209774 | A1 | 9/2008 | Robin |
| 2009/0313767 | A1 | 12/2009 | Tanner et al. |
| 2010/0024492 | A1 | 2/2010 | Leung |
| 2010/0037495 | A1 | 2/2010 | Rosenzweig et al. |
| 2010/0043257 | A1 | 2/2010 | Krebs et al. |
| 2010/0043259 | A1 | 2/2010 | Janakiraman et al. |
| 2010/0058623 | A1 | 3/2010 | Fernandez |
| 2010/0122478 | A1 | 5/2010 | Lee et al. |
| 2010/0126049 | A1 | 5/2010 | Lee et al. |
| 2010/0146826 | A1 | 6/2010 | Lee et al. |
| 2010/0199529 | A1 | 8/2010 | Ma et al. |
| 2011/0030249 | A1 | 2/2011 | Rosenzweig et al. |
| 2011/0146116 | A1 | 6/2011 | Compeau et al. |
| 2011/0173848 | A1 | 7/2011 | Lin et al. |
| 2012/0039586 | A1 | 2/2012 | Collinson et al. |
| 2012/0266502 | A1 | 10/2012 | Noto |

FOREIGN PATENT DOCUMENTS

| | | |
|---|---|---|
| CN | 202132923 | 2/2012 |
| CN | 202247451 | 5/2012 |
| CN | 202369835 | 8/2012 |
| CN | 202576979 | 12/2012 |
| CN | 202644245 | 1/2013 |
| CN | 203388805 | 1/2014 |
| EP | 2138628 | 12/2009 |
| EP | 2455540 | 5/2012 |
| WO | 2008021273 | 2/2008 |
| WO | 2009022260 | 2/2009 |
| WO | WO 2012/054433 | 4/2012 |
| WO | 2013057651 | 4/2013 |

OTHER PUBLICATIONS

Tobi, "Instruction Manual, Model #KB-1126" publicly available at least as early as Jan. 5, 2014 (8 pages).

Hann, "Steam Station Garment Steamer & Home Sanitizer User Manual" 2010 (26 pages).

Australian Patent Office Examination Report No. 1 for Application No. 2015203911 dated Mar. 1, 2017 (3 pages).

Chinese Patent Office Action for Application No. 201580007761.2 with English Translation dated Mar. 31, 2017 (30 pages).

Chinese Patent Office Action for Application No. 201580007761.2 with English Translation dated Feb. 11, 2018, 9 pages.

PORTABLE GARMENT STEAMER

RELATED APPLICATIONS

The present application is a continuation of U.S. patent application Ser. No. 14/148,296, filed Jan. 6, 2014, the entire contents of which are hereby incorporated by reference.

BACKGROUND

The present invention relates to steamers, and more particularly a portable garment steamer.

Garment steamers typically include a water tank and an electric heater for converting the liquid water in the tank to steam. The steam is discharged through a nozzle that is positioned adjacent a garment or other article to be steamed. Typically, the steamers must be connected to an external power source during use in order to provide the large amount of energy that is required to boil liquid water and convert it to steam. The large energy requirement makes it difficult to provide a cordless garment steamer because batteries typically do not provide sufficient power to make cordless operation of the steamer efficient. As used herein, the word "steam" includes water vapor as well as visible fog or mist of condensing vapor, and also condensed vapor.

SUMMARY

In one aspect, the invention provides a steamer for steaming an article, the steamer including a housing, a power cord configured to be selectively coupled to an external power source, a battery, a fluid reservoir positioned in the housing, a reservoir heating element configured to preheat fluid in the fluid reservoir, a steam generating device operable to receive preheated fluid from the fluid reservoir and generate steam, and a nozzle in fluid communication with the steam generating device. The reservoir heating element receives power from the external power source when the power cord is in communication with the external power source. The steam generating device receives power from the battery when the power cord is unplugged from the external power source. The nozzle is configured to receive the steam from the steam generating device and discharge the steam through the nozzle.

In another aspect, the invention provides a steamer including a portable housing, a conduit, and a wand movable relative to the housing. The housing includes a battery, a fluid reservoir, and a reservoir heating element configured to heat fluid in the fluid reservoir to a predetermined temperature below the boiling point of the fluid. The reservoir heating element selectively receives power from an external power source. The conduit is in fluid communication with the fluid reservoir. The wand includes a steam generating device and a nozzle. The steam generating device is in fluid communication with the fluid reservoir via the conduit, and receives power from the battery to heat the fluid in the steam generating device and generate steam. The nozzle is in fluid communication with the steam generating device to receive the steam and discharge the steam.

In yet another aspect, the invention provides a steamer for steaming an article. The steamer includes a housing, a power cord, a battery, a fluid reservoir positioned in the housing, a reservoir heating element for heating fluid in the fluid reservoir to a predetermined temperature below the boiling point of the fluid, a conduit, a wand, an atomizer operable to receive fluid from the fluid reservoir and generate a spray, and a nozzle. The power cord is configured to be selectively coupled to an external power source. The reservoir heating element receives power from the external power source when the power cord is in communication with the external power source. The conduit includes a first end and a second end. The first end is in fluid communication with the fluid reservoir. The wand is coupled to the second end of the conduit and is movable relative to the housing. The nozzle is in fluid communication with the atomizer and configured to receive the spray from the atomizer and discharge the spray through the nozzle.

In still another aspect, the invention provides a method of generating steam in a steamer. The method includes receiving fluid in a reservoir including a heating element; preheating the fluid using power from an external power source until the fluid is a predetermined temperature below a boiling temperature of the fluid; conveying the preheated fluid to a steam generating device; heating the fluid in the steam generating device to form steam, the steam generating device using power from a battery when the steamer is unplugged from the external power source; and discharging the steam through a nozzle.

Other aspects of the invention will become apparent by consideration of the detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting.

DETAILED DESCRIPTION

Figure 1:
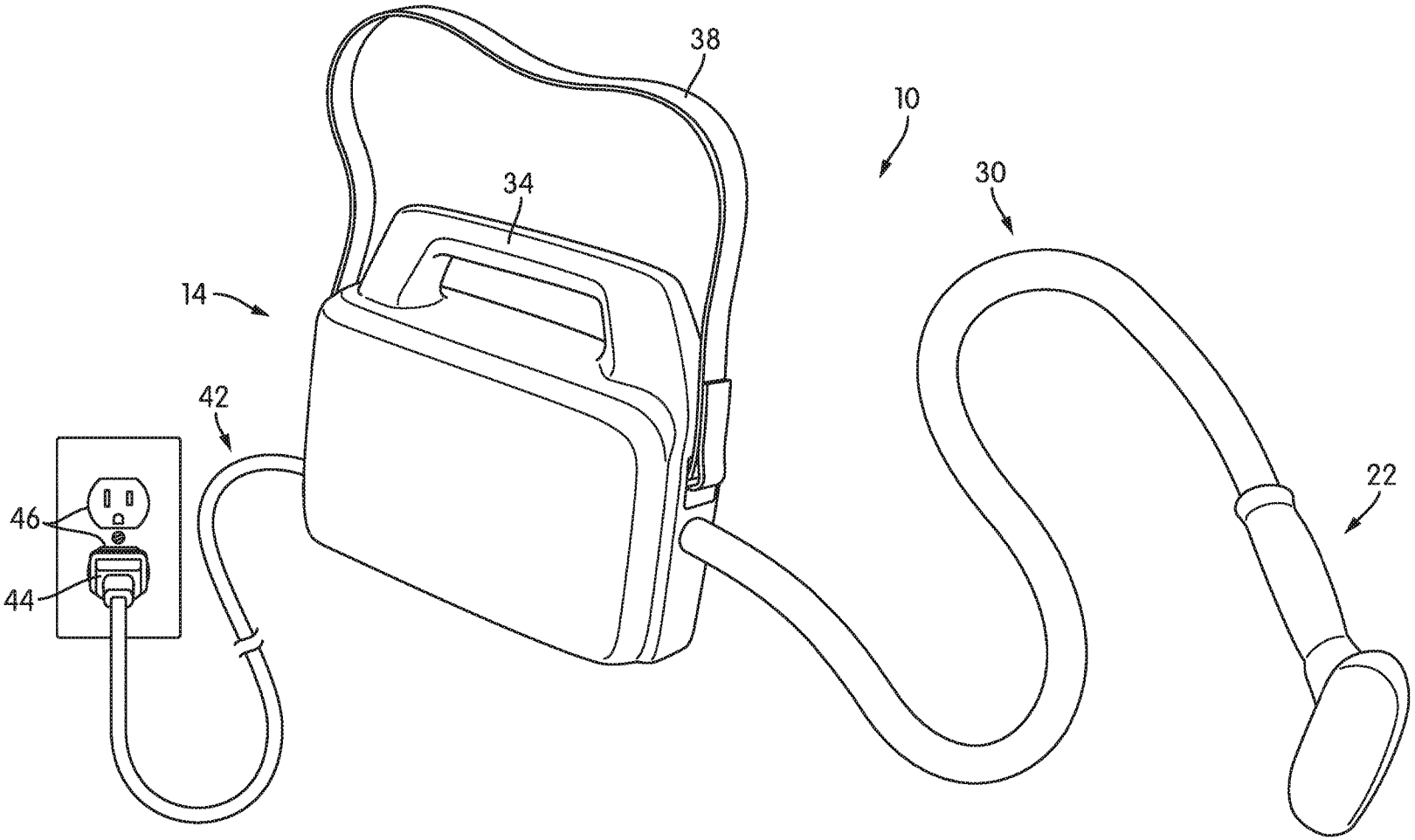
FIG. 1 is a perspective view of a garment steamer.

FIG. 1 illustrates a steamer 10. The steamer 10 includes a canister or housing 14, a wand 22 that is movable relative to the housing 14, and a conduit 30 extending between the housing 14 and the wand 22. In the illustrated embodiment, the housing 14 includes a handle 34 and a strap 38 to facilitate transporting the housing 14. A power cord 42 is coupled to the housing 14 and includes a plug 44 that can be connected to an external power source, such as an AC power outlet 46.

Figure 2:
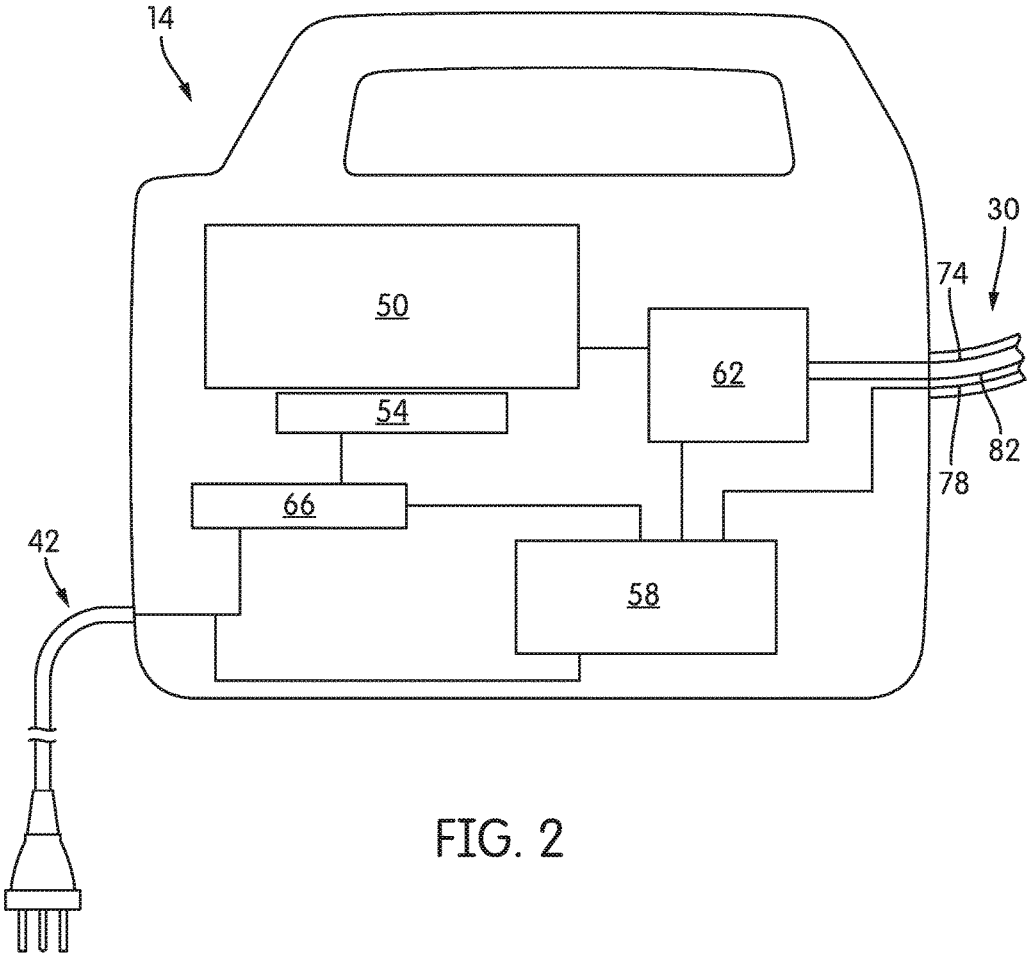
FIG. 2 is a side schematic view of a housing.

FIG. 2 schematically illustrates the components positioned within the housing 14, including a tank or reservoir 50, a reservoir heater 54, a battery 58, and a pump 62. The reservoir 50 stores a fluid, such as water. In some embodiments, the reservoir 50 is removably coupled to the housing 14 so that the reservoir 50 may be removed and re-filled with fluid; in other embodiments, the housing 14 includes a port through which fluid may be poured to re-fill the reservoir 50. The reservoir heater 54 provides heat to the fluid in the reservoir 50, thereby raising the temperature of the fluid. The reservoir heater 54 is in electrical communication with both the power cord 42 and the battery 58 by a switch 66. In one embodiment, the heater 54 and/or reservoir 50 is insulated to aid in maintaining fluid temperature and to inhibit heat transfer to the battery 58 and/or the exterior of the housing 14.

When the plug 44 is connected to the external power source, the switch 66 places the reservoir heater 54 in electrical communication with the power cord 42 such that the heater 54 receives power from the external power source. In the illustrated embodiment, the power cord 42 also provides power to the battery 58 so that the battery 58 is charged by the external power source when the power cord 42 is connected to the external power source. The reservoir heater 54 heats the fluid in the reservoir 50 to a temperature below the boiling point of the fluid. In one embodiment, the heater 54 heats water in the reservoir 50 to approximately five to ten degrees Celsius below the boiling point. When the power cord 42 is disconnected from the external power source, the switch 66 is positioned to place the steam generating device 102 (discussed below with respect to FIG. 3), and optionally the heater 54, in electrical communication with the battery 58. In one embodiment, the heater 54 receives power from the battery 58 to maintain the fluid in the reservoir 50 at the desired temperature; the battery 58 powers the heater 54 if the temperature of the fluid in the reservoir decreases below a predetermined temperature. In other embodiments, the heater 54 does not receive power from the battery 58. In some embodiments, the switch 66 may also be positioned in an "off" state so that the heater 54 is unpowered (i.e., the heater 54 is not in communication with the power cord 42 or the battery 58).

The pump 62 is in fluid communication with the reservoir 50 and the conduit 30. The pump 62 is also in electrical communication with the battery 58, which powers the pump 62 to convey fluid from the reservoir 50, through the conduit 30, and into the wand 22. In the illustrated embodiment, the conduit 30 includes at least one fluid line 74 for conveying fluid from the housing 14 to the wand 22 (FIG. 1), a first electrical line 78 for transmitting electricity from the battery 58 to components of the wand 22, and a second electrical line 82 for transmitting a control signal from the wand 22 to the pump 62 to operate the pump 62 as discussed below.

Figure 3:
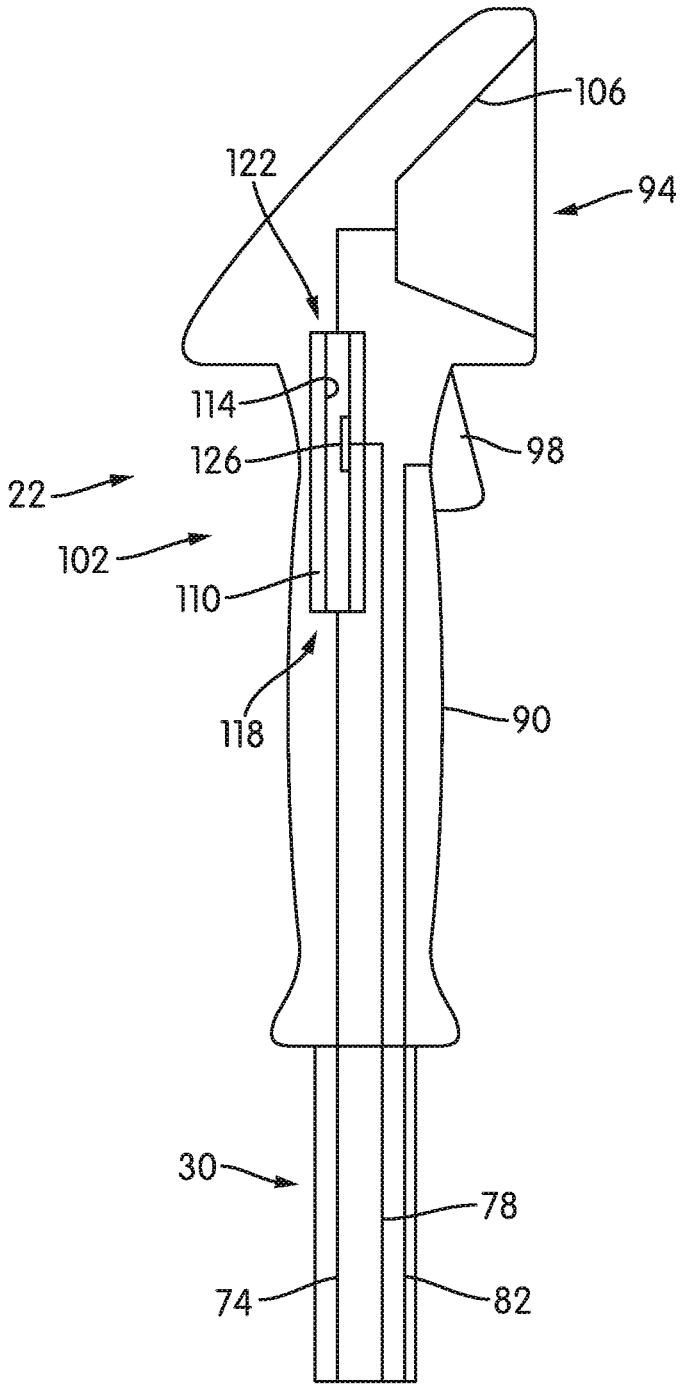
FIG. 3 is a side schematic view of a wand.

FIG. 3 schematically illustrates the components positioned within the wand 22. In the illustrated embodiment, the wand 22 includes a handle 90 and an end opposite the handle 94. An actuator 98 (e.g., a trigger) is positioned proximate the handle 90 and is operable by a user to actuate the pump 62 (FIG. 2). In other embodiments, the actuator 98 may be located in a different position on the wand 22 or may be positioned on the housing 14.

The wand 22 also includes a steam generating device 102 and a nozzle 106 positioned on the end 94 of the wand 22 and in fluid communication with the steam generating device 102. The steam generating device 102 is in fluid communication with the fluid line 74 in the conduit 30 to receive water from the pump 62 (FIG. 2). In the illustrated embodiment, the steam generating device 102 includes cylinder 110 defining a bore 114 having a first end 118, a second end 122 opposite the first end 118, and a heating element 126 positioned at least partially within the bore 114. The heating element 126 is in electrical communication with the battery 58 (FIG. 2) by the electrical line 78 in the conduit 30. In the illustrated embodiment, the cylinder 110 of the steam generating device 102 is a zinc-aluminum alloy and the heating element 126 is a resistive heater embedded in the cylinder 110. The water from the fluid line 74 flows under pressure from the first end 118 of the bore 114 toward the second end 122 and passes the heating element 126. The heating element 126 heats the water, causing the water to be converted to steam. In one embodiment, the heating element 126 is a flash heater. The steam passes from the second end 122 of the bore 114 to the nozzle 106, where the steam is discharged from the end 94 of the wand 22 and onto an article or garment (not shown). In one embodiment, the nozzle 106 includes a plurality of openings through which the steam is discharged.

Figure 5:
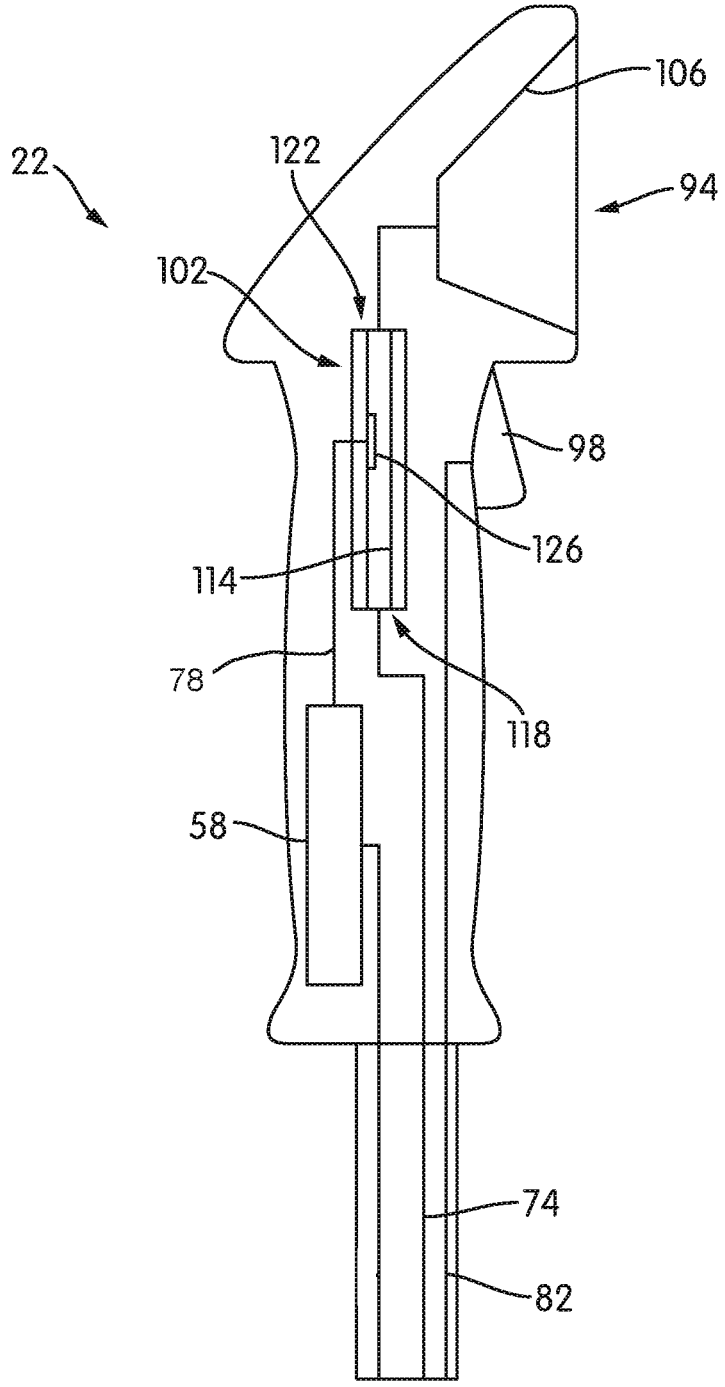
FIG. 5 is a side schematic view of a wand according to another embodiment.
Figure 6:
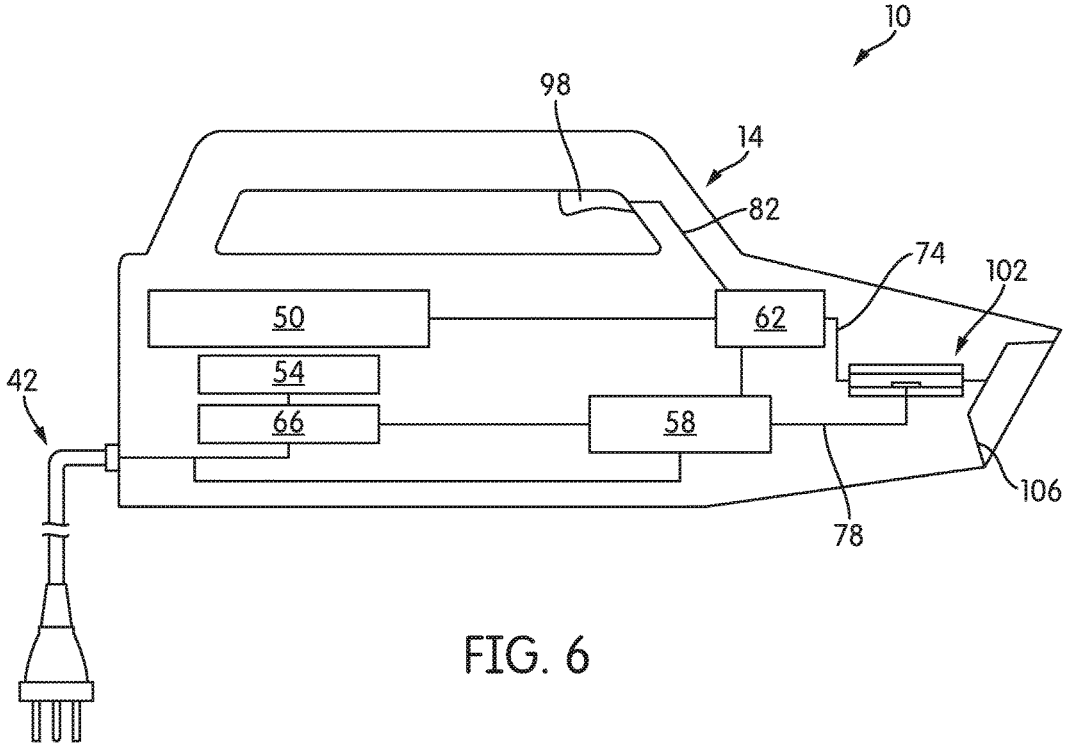
FIG. 6 is a side schematic view of a garment steamer according to another embodiment.

FIG. 5 illustrates another embodiment of the steamer 10 in which the battery 58 is positioned on the wand 22. In addition, FIG. 6 illustrates another embodiment in which the steamer 10 is formed as a handheld unit. The actuator 98 and the steam generating device 102 are positioned on the housing 14, and the nozzle 106 is integrally formed on the housing 14. In addition, in other embodiments, the fluid transfer between the reservoir 50 and the steam generating device 102 may be gravity-fed, such that the fluid flows primarily due to the force of gravity.

Prior to using the steamer 10 to steam garments, the power cord 42 is connected to the external power source to pre-heat the water in the reservoir 50 to a temperature that is a predetermined amount below the boiling point of the water. The external power source may also charge the battery 58. When a user wishes to apply the steamer 10 to a garment or other article, the user may unplug the power cord 42 and transport the portable housing 14 (e.g., using the handle 34 or carrying strap 38). In one embodiment, when the power cord 42 is unplugged, the battery 58 powers the reservoir heater 54 to maintain the temperature of the fluid at the desired level. In other embodiments, when the power cord 42 is unplugged, the reservoir 50 is not further heated. When the nozzle 106 is positioned adjacent the article to which the steam will be applied, the user moves the actuator 98, thereby operating the pump 62. The pump 62 conveys liquid water from the reservoir 50, through the fluid line 74 in the conduit 30 and into the steam generating device 102. The steam generating device 102 converts the liquid water to steam, which is then discharged through the nozzle 106 and onto the article.

The portable steamer 10 permits a user to apply steam to an article without requiring the steamer 10 to be plugged into an external power source (that is, the steamer 10 is cordless during use). The steamer 10 is plugged in before use to charge the battery 58 is and heat the water in the reservoir 50, thereby utilizing an external power source to provide a significant amount of the energy required to prepare the steamer 10 for use. The charging function minimizes the energy required from the battery 58, which simply provides the necessary energy to maintain the water at the predetermined temperature, to operate the pump 62, and to power the heating element 126 of the steam generating device 102. In addition, instead of converting a large amount of liquid water to steam, the steam generating device 102 converts a relatively small amount of liquid water to steam at a given instant. This reduces the amount of energy required to produce the steam, and permits greater control over the amount of steam that is applied to the article. Also, most of the components for the steamer 10 are contained in the housing 14, reducing the weight of the handheld wand 22. Furthermore, although the water is heated in the reservoir 50, the water remains in its liquid state while in the reservoir 50 and pressurization of the fluid typically occurs after the fluid exits the reservoir 50.

In some embodiments, the power cord 42 is also connected to the pump 62 and the steam generating device 102 and provides power to those components when the power cord 42 is connected to the external power source. The connection between each component and the power cord 42 may override the connection between the component and the battery 58 so that the component receives power from the external power source when the power cord 42 is plugged in, thereby allowing the steamer 10 to be operated while the power cord 42 is plugged in without requiring energy from the battery 58. In addition, the power cord 42 may pre-heat the heating element 126 of the steam generating device 102, further reducing the energy required from the battery 58 during use.

Figure 4:
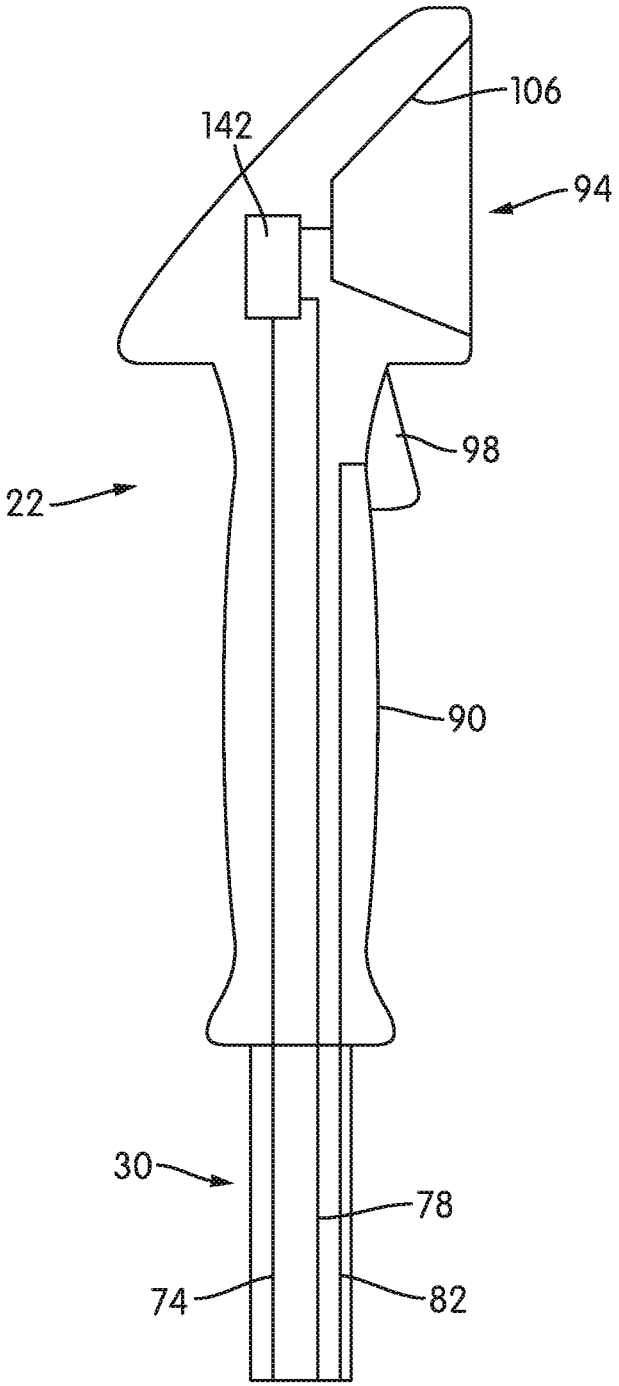
FIG. 4 is a side schematic view of a wand according to another embodiment.

FIG. 4 illustrates another embodiment of the wand 22 including an atomizer 142 instead of the steam generating device 102. The atomizer 142 may be, for example, a piezoelectric atomizer that is actuated by ultrasonic vibrations to convert a liquid in a tube into a mist or spray that is discharged from the nozzle 106. The atomizer 142 may be powered by the battery 58. In this embodiment, the water in the reservoir 50 may be heated to within five degrees Celsius of the boiling point. In still other embodiments, the wand 22 could use a series of baffles to transfer heat to the fluid and convert the liquid water to steam.

Thus, the invention provides, among other things, a portable garment steamer. Although the invention has been described in detail with reference to certain preferred embodiments, variations and modifications exist within the scope and spirit of one or more independent aspects of the invention as described.

What is claimed is:

1. A method of generating steam in a steamer comprising:
receiving fluid in a reservoir including a heating element;
preheating the fluid using power from an external power source until the fluid is a predetermined temperature below a boiling temperature of the fluid;
conveying the preheated fluid to a steam generating device;
heating the fluid in the steam generating device to form steam, the steam generating device using power from a battery when the steamer is unplugged from the external power source; and
discharging the steam through a nozzle.

2. The method of claim 1, further comprising using power from the battery to preheat the fluid in the reservoir when the reservoir heating element is disconnected from the external power source.

3. The method of claim 1, further comprising using power from the external power source to heat the fluid in the steam generating device when the steam generating device is connected to the external power source.

4. The method of claim 1, further comprising charging the battery using power from the external power source.

5. The method of claim 1, wherein preheating the fluid includes heating the fluid in the reservoir to a temperature that is approximately five to ten degrees Celsius below the boiling temperature of the fluid.

6. The method of claim 1, further comprising maintaining the fluid at the predetermined temperature by powering the reservoir heating element with the battery when the steamer is disconnected from the external power source.

7. The method of claim 1, wherein the steam generating device includes a cylinder defining a bore having a first end and a second end, the first end in fluid communication with the reservoir and the second end in fluid communication with an end of the wand, and wherein a steam generating heating element is at least partially positioned within the bore.

8. A method of operating a steamer, the method comprising:
receiving fluid in a reservoir including a heating element;
preheating the fluid to a predetermined temperature below a boiling temperature of the fluid by powering the heating element using power from an external power source;
after preheating the fluid to the predetermined temperature, disconnecting the external power source;
continuing to heat the fluid using power from a battery when the steamer is disconnected from the external power source; and
conveying the fluid to a wand.

9. The method of claim 8, wherein the heating element receives power from the battery when a temperature of the fluid in the reservoir drops below the predetermined temperature.

10. The method of claim 8, wherein the predetermined temperature is approximately 5-10 degrees Celsius below the boiling point of the fluid.

11. The method of claim 8, further comprising maintaining the fluid at the predetermined temperature using power from the battery when the steamer is disconnected from the external power source.

12. The method of claim 8, further comprising converting the fluid into steam using a steam generating device positioned in the wand.

13. The method of claim 12, wherein the steam generating device includes a heating element powered by the battery when the steamer is disconnected from the external power source.

14. The method of claim 13, wherein the steam generating device includes a cylinder defining a bore having a first end and a second end, the first end in fluid communication with the reservoir and the second end in fluid communication with an end of the wand, and wherein the heating element is at least partially positioned within the bore.

15. The method of claim 8, further comprising charging the battery when the steamer is connected to an external power source.

16. The method of claim 8, wherein the fluid is conveyed to the wand using a pump powered by the battery when the steamer is disconnected from the external power source.

17. The method of claim 16, wherein the pump is operable by an actuator.

* * * * *